US006460455B1

(12) United States Patent
Eltner et al.

(10) Patent No.: US 6,460,455 B1
(45) Date of Patent: Oct. 8, 2002

(54) METHOD FOR DAMPENING A PLANOGRAPHIC PRINTING FORM AND DAMPENING UNIT OF A PLANOGRAPHIC PRINTING MACHINE FOR PERFORMING THE METHOD

(75) Inventors: Bruno Eltner, Heidelberg; Bernd Müller, Nussloch; Mathias Zuber, Helmstadt-Bargen, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/527,122

(22) Filed: Mar. 16, 2000

(30) Foreign Application Priority Data

Mar. 16, 1999 (DE) ..... 199 11 568

(51) Int. Cl.[7] ..... B41F 7/26; B41F 7/40

(52) U.S. Cl. ..... 101/148; 101/352.01

(58) Field of Search ..... 101/148, 450.1, 101/350.2, 351.1, 352.01

(56) References Cited

U.S. PATENT DOCUMENTS

| | | | | |
|---|---|---|---|---|
| 4,290,360 A | | 9/1981 | Fischer | |
| 4,440,081 A | | 4/1984 | Beisel | |
| 4,922,818 A | | 5/1990 | Junghans | |
| 5,086,696 A | * | 2/1992 | Junghans | 101/148 |
| 5,375,522 A | | 12/1994 | Junghans | |
| 5,471,926 A | * | 12/1995 | Junghans et al. | 101/148 |
| 5,823,107 A | * | 10/1998 | Beisel et al. | 101/148 |
| 5,884,557 A | * | 3/1999 | Furbass | 101/148 |
| 6,257,138 B1 | * | 7/2001 | Bialek | 101/142 |

FOREIGN PATENT DOCUMENTS

| | | |
|---|---|---|
| DE | 1 808 909 | 6/1970 |
| DE | 29 38 676 A1 | 5/1980 |
| DE | 29 02 228 C2 | 7/1980 |
| DE | 29 02 228 A1 | 7/1980 |
| DE | 30 16 366 A1 | 12/1980 |
| DE | 31 46 223 C2 | 6/1983 |
| DE | 36 38 813 A1 | 5/1987 |
| DE | 87 16 847.2 | 3/1988 |
| DE | 87 16 847.2 U1 | 3/1988 |
| DE | 36 44 982 A1 | 11/1988 |
| DE | 39 23 636 A1 | 4/1991 |
| DE | 91 10 345.2 | 11/1991 |
| DE | 93 05 742.3 | 7/1993 |
| DE | 93 16 916.7 | 3/1994 |
| DE | 296 01 067 U1 | 7/1996 |
| EP | 0 722 829 A2 | 7/1996 |
| GB | 2 035 903 A | 6/1980 |
| GB | 2 277 054 B | 10/1994 |

* cited by examiner

*Primary Examiner*—Stephen R. Funk
(74) *Attorney, Agent, or Firm*—Laurence A. Greenberg; Werner H. Stemer; Ralph E. Locher

(57) ABSTRACT

A method for dampening a rotating planographic printing form via an ink applicator roller for indirectly dampening the planographic printing form and via a connecting roller in engagement with the ink applicator roller and engaged by a dampener roller for dampening the planographic printing form, includes, during dampening, rotating the dampener roller at a circumferential speed differing from the circumferential speed of the planographic printing form; a dampening unit for performing the method; and a planographic printing machine including the dampening unit.

7 Claims, 4 Drawing Sheets

METHOD FOR DAMPENING A PLANOGRAPHIC PRINTING FORM AND DAMPENING UNIT OF A PLANOGRAPHIC PRINTING MACHINE FOR PERFORMING THE METHOD

BACKGROUND OF THE INVENTION

Field of the Invention

The invention relates to a method for dampening a rotating planographic printing form via an ink applicator roller for indirectly dampening the planographic printing form and via a connecting roller that is in engagement with the ink applicator roller and is engaged by a dampener roller for dampening the planographic printing form. The invention relates, furthermore, to a dampening unit of a planographic printing machine having a first dampening unit roller engaging solely with a dampener roller.

Two fundamental possibilities for dampening planographic printing forms have become known heretofore, namely, on the one hand, a direct application of pure dampening medium via a dampener roller and, on the other hand, an indirect application of dampening medium in the form of a printing ink/dampening medium emulsion via a dampener or dampening medium applicator roller or an ink applicator roller.

Modern offset printing machines have inking and dampening units, during a coupled operation of which the dampening medium is applied to the printing form partly indirectly via a dampener roller and partly indirectly via an ink applicator roller located immediately downline from the dampener roller, as viewed in the direction of rotation of the printing form cylinder, and the dampener roller applies a dampening medium/printing ink emulsion to the printing form. The indirect application of dampening medium is made possible by a connecting roller coupling the ink applicator roller with the dampener roller.

A dampening/inking unit of such an offset printing machine is described, for example, in the published German Patent Document DE 87 16 847 U1. For indirect dampening, the dampening/inking unit has an ink applicator roller and a dampener roller. An ink distributor roller forms a connecting roller arranged between the ink applicator roller and the dampener roller. This document which describes a utility model says nothing with regard to the type of rotary drive of a dampening roller solely engaging the dampener or dampening medium applicator roller, i.e., whether the dampening roller is driven by the dampener or dampening medium applicator roller, for example, via friction, or as to the circumferential speed of the dampener or dampening medium applicator roller. A disadvantage of this dampening/inking unit is that the printing form dampened by the latter has to be washed comparatively frequently, particularly when fluffy print carriers are being printed, because free paper fibers or lint causing so-called hickeys in the print image are deposited on the printing form as a result of an absence of rolling slippage between the dampener roller and the printing form. The frequent washing, in the case of print orders with a large run, results in printing interruptions which, respectively, entail restart paper wastage or spoilage.

A dampening and inking unit described in the published German Patent Document DE 31 46 223 C2 is another example for the construction of such offset printing machines. The problem described hereinabove cannot be solved by this dampening and inking unit, because the dampener roller, referred to therein unusually as an ink applicator roller, has to rotate at the circumferential speed of the plate cylinder, as is stressed expressly in this German patent document.

Furthermore, the German Patent Document DE 93 05 742 U1 describes a dampening unit for offset printing machines, having an applicator roller which, although capable of being driven at a different speed from that of a plate cylinder, does not engage or rest against a connecting roller, so that this dampening unit can be used only for direct dampening via the applicator roller, and not for indirect dampening. A printing ink/dampening medium emulsion forms on the applicator roller as ink is removed from the printing form.

In order to achieve good print quality, what is sought after is the assurance not only of ghost-free inking, but also of ghost-free dampening of the printing form. The requirements are very stringent in this respect, particularly with regard to the dampening units indirectly dampening the printing form. In the construction of dampening units, these requirements can be satisfied by a dampening-unit roller rolling solely on the dampener or dampening-medium applicator roller.

A dampening unit described in the published German Patent Document DE 91 10 345 meets the demands or requirements with respect to a ghost-free application of dampening medium only when straightforward direct dampening is employed. In this dampening unit connection, a dampener roller engages a dampening distributor roller driven, via gearwheels and consequently formlockingly or positively, via shaft journals of the dampener roller, and is separated from an inking unit roller located adjacent thereto. In this regard, it is noted that a formlocking connection is one which connects two elements together due to the shape of the elements themselves, as opposed to a forcelocking connection which locks the elements together by force external to the elements. One disadvantage of the dampening unit described in the published German Patent Document DE 91 10 345 is that no dampening unit connection is provided therein for the indirect dampening of a plate cylinder. Throwing the dampener roller onto the inking unit roller located adjacent thereto serves either for utilizing the dampener roller as an applicator roller for solely applying printing ink to the plate cylinder or as a washing connection. Moreover, throwing the dampener roller onto the inking unit roller adjacent thereto necessarily gives rise, because of the construction, to throwing the dampener roller off the dampening distributor roller that is mounted in a side frame so as to be fixed against movement relative to the latter, so that, for this reason too, ghost-free indirect dampening by this dampening unit is not possible.

Furthermore, the published German Patent Document DE 29 02 228 C2 describes an inking unit and a dampening unit wherein, during indirect dampening, an inking unit roller rotates at a surface speed corresponding approximately to the surface speed of the plate cylinder, and dictates the surface speed of a dampener roller engaging the inking unit roller and, therefore, rolls on the plate cylinder without slippage. Only during straightforward direct dampening separate from the ink supply does the dampener roller rotate at a circumferential speed that is about 10% above or below the circumferential speed of the plate cylinder. A serious disadvantage of this dampening unit is that there is no dampening unit roller provided therein for smoothing the film of dampening medium on the dampener roller and, for this purpose, engaging solely with this dampener roller. A dampening unit roller for transferring the dampening medium from a water fountain roller onto the dampener roller lacks the construction-related precondition that is necessary for the effective prevention of ghosting and thereby calls for engagement only with the dampener roller.

SUMMARY OF THE INVENTION

It is accordingly an object of the invention to provide a method for dampening a planographic printing form indirectly by which paper wastage or spoilage is reduced, and to provide a dampening unit for performing the method of dampening a planographic printing form in a virtually ghost-free manner.

With the foregoing and other objects in view, there is provided, in accordance with one aspect of the invention, a method for dampening a rotating planographic printing form via an ink applicator roller for indirectly dampening the planographic printing form and via a connecting roller in engagement with the ink applicator roller and engaged by a dampener roller for dampening the planographic printing form, which comprises, during dampening, rotating the dampener roller at a circumferential speed differing from the circumferential speed of the planographic printing form.

In accordance with another mode, the method of the invention includes rolling a first dampening unit roller solely on the dampener roller so as to equalize or uniformly distribute in the circumferential direction a film of dampening medium located on the dampener roller.

In accordance with a further mode, the method of the invention includes axially traversing with the first dampening unit roller and thereby equalizing or uniformly distributing the film of dampening medium in the axial direction.

In accordance with an added mode, the method of the invention includes rolling a second dampening unit roller solely on the dampener roller so as to equalize or uniformly distribute the film of dampening medium in the circumferential direction.

In accordance with an additional mode, the method of the invention includes axially traversing with the second dampening unit roller and thereby equalizing or uniformly distributing the film of dampening medium in the axial direction.

In accordance with yet another mode, the method of the invention includes maintaining the dampener roller stationary in the axial direction.

In accordance with another aspect of the invention, there is provided a dampening unit of a planographic printing machine, having a first dampening unit roller in contact solely with a dampener roller, comprising an adjusting device for displacing the dampener roller out of a spaced-away position and into an in-contact position wherein the dampener roller is in contact with a connecting roller, and a rotary drive for formlockingly driving the first dampening unit roller and, when the dampener roller is in the in-contact position, the first dampening unit roller is in contact with the dampener roller.

In accordance with another feature of the invention, the dampener roller and the first dampening unit roller are displaceable jointly by the adjusting device, so that the dampener roller is displaceable out of the spaced-away position and into the in-contact position and, simultaneously, the first dampening unit roller is entrainable thereby by being in permanent contact with the dampener roller.

In accordance with a further feature of the invention, the dampening unit includes a second dampening unit roller in contact solely with the dampener roller.

In accordance with an added feature of the invention, the dampener roller, the first dampening unit roller and the second dampening unit roller are jointly displaceable by the adjusting device, so that the dampener roller is displaceable out of the spaced-away and into the in-contact position and, simultaneously, both the first dampening unit roller and the second dampening unit roller are entrainable therewith by being in permanent contact with the dampener roller.

In accordance with an additional feature of the invention, the adjusting device comprises an eccentric bearing.

In accordance with yet another feature of the invention, the dampener roller which, in the in-contact position, is in contact with the connecting roller, is drivable by the rotary drive with slippage relative to a planographic printing form, so as to roll on the latter.

In accordance with a further aspect of the invention, there is provided a planographic printing machine having at least one dampening unit constructed in accordance with at least one of the foregoing features of the invention.

In accordance with a concomitant feature of the invention, the planographic printing machine is an offset rotary printing machine.

The method according to the invention for dampening a rotating planographic printing form via an ink applicator roller indirectly dampening the planographic printing form and via a connecting roller which, simultaneously, engages the ink applicator roller that is engaged by a dampener roller for dampening the planographic printing form is distinguished in that, during dampening, the dampener roller rotates at a circumferential speed differing from the circumferential speed of the planographic printing form.

Due to the speed difference between the circumferential speeds of the planographic printing form and of the dampener roller, free paper fibers or lint and the like causing hickeys in the print image are removed from the planographic printing form by the dampener roller, so that the planographic printing form needs to be washed only rarely and therefore restart waste paper or spoilage is advantageously avoided. The cleaning effect is afforded during the simultaneous application of a printing ink/dampening medium emulsion onto the planographic printing form by the ink applicator roller. For this purpose, the connecting roller is in circumferential rolling contact both with the ink applicator roller and with the dampener roller, so that the dampening medium is conveyed from the dampener roller via the connecting roller onto the ink applicator roller and is intermixed with printing ink located on the ink applicator roller, to form a printing ink/dampening medium mixture which is optimum for printing. At the same time, indirect dampening of the planographic printing form may also take place via the dampener roller, in that some of the printing ink located on the ink applicator roller passes via the connecting roller onto the dampener roller and, together with the dampening medium located on the dampener roller, likewise forms a printing ink/dampening medium emulsion. As a rule, in such a case, the printing ink fraction of the emulsion located on the ink applicator roller will be larger than the printing ink fraction of the emulsion located on the dampener roller.

A refinement in the method according to the invention is distinguished in that, during dampening, a first dampening unit roller rests only against the dampener roller and against no other roller otherwise and, consequently, in contrast with a transfer roller resting against two rollers, is especially able to work the dampening medium into the printing ink which has passed onto the dampener roller and to smoothen the film of dampening medium in the circumferential direction.

A further improvement in the method is distinguished in that smoothing of the film of dampening medium takes place in the axial direction of the first dampening unit roller due to the lateral oscillation of the latter. In this way, so-called axial ghosting is avoided in a highly reliable manner, and there is a particularly thorough intermixing of the printing ink which has passed onto the dampener roller with the dampening medium located on the latter, to form an emulsion suitable for printing.

A further method improvement is distinguished in that, in addition to the first dampening unit roller mentioned hereinbefore, a further dampening unit roller also rolls on the dampening unit roller in order to equalize or uniformly distribute the film of dampening medium located on the dampener roller. This additional second dampening unit roller, just like the first dampening unit roller, is not a transfer roller, but instead, rests only against a single roller, specifically the dampener roller. It was shown that, when the inking unit to which the ink applicator roller belongs is used as a so-called short inking unit, there are more stringent requirements with regard to the working of the dampening medium into the printing ink located on the dampener roller. In the so-called short inking unit mode, not all the ink applicator rollers of the inking unit which are altogether present are used for inking the planographic printing form. For example, only one ink applicator roller or only two ink applicator rollers out of four ink applicator rollers altogether present are used. As compared with a so-called normal inking unit mode of the inking unit, wherein all of the ink applicator rollers which are present are used for inking, the percentage of printing ink fractions applied by the applicator rollers are shifted. In other words, a higher fraction of the printing ink applied as a whole is applied by the dampener roller in the short inking unit mode than in the normal inking unit mode. The requirements, which are thus also more stringent, with regard to the application of dampening medium by the dampener roller in the short inking unit mode can be satisfied particularly effectively by two dampening unit rollers rolling solely on the dampener roller. It has been shown, furthermore, that it is expedient to use two dampening unit rollers rolling solely on the dampener roller not only in the short inking unit mode, but also in the normal inking unit mode and not only during the indirect dampening of the planographic printing form via the ink applicator roller, but also during the straightforward direct dampening of the planographic printing form via the dampener roller. It is therefore beneficial that, when the dampening unit is separated from the inking unit, for example, by setting the dampener roller at a distance from the connecting roller, during the direct dampening of the planographic printing form solely via the dampener roller, both the first dampening unit roller and the second dampening unit roller remain resting against the dampener roller.

A further advance in the method is distinguished by the fact that, for the axial smoothing of the film of dampening medium located on the dampener roller, the second dampening unit roller oscillates laterally. In many applications, the first dampening unit roller may indeed be stationary in the axial direction while the second dampening unit roller traverses axially, however, preferably both the first dampening unit roller and the second dampening unit roller traverse simultaneously in the axial direction. So-called axial ghosting is thereby avoided in an absolutely reliable manner.

A further improvement in the method is distinguished in that the dampener roller does not traverse in the axial direction thereof. In many applications, the dampener roller may admittedly traverse axially, this oscillation being capable of being driven via axial frictional entrainment by the axially traversing first dampening unit roller and/or the axially traversing second dampening unit roller. It has been shown, however, that a favorable application of dampening medium onto the planographic printing form is obtained if the dampener roller is stationary in the axial direction and at least one dampening distributor roller rolls on the latter and, simultaneously, oscillates. The use of two dampening distributor rollers rolling on the axially stationary dampener roller and, simultaneously, oscillating produces a high degree of stability in the application of dampening medium onto the planographic printing form even under printing conditions which are changed in the interim to disturbance variables, such as, for example, printing interruptions.

The dampening unit of a planographic printing machine in accordance with the invention, having a dampening unit roller that rests solely against a dampener roller, is distinguished in that the dampener roller is displaceable by an adjusting device out of a spaced-away position into a position resting against a connecting roller, and in that the dampening unit roller is formlockingly or positively drivable by a rotary drive and, when the dampener roller is in the incontact or engaging position, rests against the latter.

This dampening unit is particularly suitable for performing the method according to the invention. During the indirect dampening of a planographic printing form, the dampening roller rolling only on the dampener roller and otherwise on no other roller produces an equalization or uniform distribution of the film of dampening medium, so that ghosting is largely avoided. During this indirect dampening, the dampener roller is in rolling contact with the connecting roller, so that the dampening medium passes from the dampener roller via the connecting roller into the inking unit. In this case, the connecting roller also has resting against it, in addition to the dampener roller, an inking unit roller that is preferably the ink applicator roller serving for the indirect dampening of the planographic printing form. If the dampening unit is to be used solely for the direct dampening of the planographic printing form, it is possible for the dampener roller to be thrown off the connecting roller by the adjusting device, so that dampening medium can no longer flow out of the dampening unit via the connecting roller and into the inking unit.

The drive for the dampening unit roller by the rotary drive gives rise to advantageous alternative embodiments of the dampening unit. For example, the dampener roller may also be driven by the rotary drive at the same time as the dampening unit roller. For this purpose, the rotary drive may drive the dampening unit roller rotatively via a gear transmission, the dampening unit roller driving the dampener roller rotatively solely via frictional entrainment. For this purpose, the outer circumferential surface of the dampening unit roller may be roughened and provided, for example, with well-shaped depressions and/or cap-shaped elevations. In this case, the dampener roller has a soft outer circumferential surface formed, for example, of rubber. According to a second embodiment of the joint drive of the dampening unit roller and of the dampener roller by the rotary drive, not only is the dampening unit roller driven by the rotary drive via a gear transmission, but the dampener roller is also driven via a gear transmission. Preferably, a gearwheel that is connected, fixed against rotation, to the dampener roller and arranged coaxially to the latter is in meshing engagement with a further gearwheel that is connected, fixed against rotation, to the dampening unit roller and arranged coaxially with the latter and is seated on a shaft driven by the rotary drive or is in meshing engagement with a third gearwheel driven by the rotary drive.

In all the different embodiments of the drive of the dampener roller, i.e., via frictional entrainment or by a gear transmission, the rotary drive for rotatively driving the dampening unit roller may be an electromotive rotary drive of the planographic printing machine, the rotary drive for driving the planographic printing form, or an electromotive individual drive of the dampening unit, the individual drive being in addition to the rotary drive. In the first-mentioned case, the rotary drive is an electric motor which, via a gear transmission, rotates the printing form cylinder carrying the planographic printing form to be dampened by the dampening unit. This electric motor may, for example, be a main drive of the planographic printing machine, the main drive rotatively driving a plurality of printing units of the planographic printing machine simultaneously. In the second-mentioned case, the planographic printing machine also has, in addition to the electric motor for driving the printing form cylinder having the planographic printing form, a further electric motor, by which the dampening unit roller can be driven formlockingly or positively and the dampener roller can also be driven. Via an electronic control device, the individual drive can be activated in co-ordination with the rotary drive driving the printing form cylinder and, for example, in the event of a change in the printing speed, can correspondingly follow up the direction of the change, i.e., an increase or decrease. In addition to this activation of the individual drive of the dampening unit roller in co-ordination with the rotary drive of the planographic printing form, the individual drive may be activatable, independently of the rotary drive of the planographic printing form, by the electronic control device. For example, percentage values may be capable of being set or of being programmed in the electronic control device, which relate to the circumferential speed of the planographic printing form and describe the speed difference between the circumferential speed of the dampener roller and the dampening unit roller and the circumferential speed of the planographic printing form.

An advantageous embodiment improving the dampening unit according to the invention is distinguished in that the adjusting device is constructed in such a way that, when the dampener roller is thrown onto the connecting roller, a simultaneous displacement of the dampening unit roller is ensured, so that the circumferential contact of the latter with the dampener roller is not lost. Likewise, when the dampener roller is thrown off the connecting roller, the dampening unit roller can be entrained with the dampener roller by permanently resting against or engaging the latter. The scope of the invention also includes dampening units, the adjusting device of which is constructed in such a way that, first, a displacement of the dampener roller out of the spaced-away position thereof from the connecting roller and into the position thereof wherein it is in contact with or is resting against the connecting roller occurs and, subsequently, the dampening unit roller is thrown onto the dampener roller, the dampener roller being temporarily released from the dampening unit roller during displacement out of the spaced-away position and into the in-contact position wherein it rests against the connecting roller. In this case, the dampening unit roller is able to follow up the displacement of the dampener roller after the displacement of the latter. It has been shown, however, that it is more beneficial to displace the dampener roller and the dampening unit roller as a unit. This may take place advantageously during the dampening of the rotating planographic printing form by the dampening unit, so that, while dampening is taking place, it is possible for the planographic printing machine to be changed over from straightforward direct dampening via the dampener roller, with the inking unit uncoupled from the dampening unit, to indirect dampening via the ink applicator roller, with the inking unit connected to the dampening unit via the connecting roller. With the dampening unit roller held permanently so as to rest against the dampener roller during displacement, ghosting streaks are thus avoided, which would in many cases risk being caused by subsequent placement of the dampening unit roller onto the dampener roller which is already in the in-contact position.

A further embodiment of the dampening unit is distinguished in that the dampening unit comprises, in addition to the first dampening unit roller mentioned hereinbefore, a second dampening unit roller which, like the first dampening unit roller, rests only against the dampener roller and otherwise against no other roller. A dampening unit constructed in this way is suitable, in particular, for carrying out an improvement in the method according to the invention which has already been described herein in this regard.

A further embodiment of the dampening unit is distinguished in that, for throwing the dampener roller onto the connecting roller, the dampener roller, the first dampening unit roller and the second dampening unit roller are capable of being displaced simultaneously by the adjusting device, without losing the circumferential contact of the first dampening unit roller with the dampener roller and of the second dampening unit roller with the dampener roller during the displacement. This different embodiment is advantageous particularly when the dampening unit is coupled to the inking unit while the dampening of the planographic printing form by the dampening unit is taking place, because, by a dampening unit constructed in this way, any streaks on the dampener roller caused by the first dampening unit roller and any streaks on the dampener roller caused by the second dampening unit roller are reliably avoided. The dampener roller, the first dampening unit roller and the second dampening unit roller, respectively, may be mounted rotatably in a common roller carrier, for example, in the form of a bearing plate, and, by the adjustment of the roller carrier, for example, by pivoting the roller carrier, the dampener roller can be set out of the throw-off position into the position in which it rests against the connecting roller, and the roller carrier keeps the first dampening unit roller in permanent contact with the dampener roller and the second dampening unit roller likewise in permanent contact with the dampener roller. In many applications, it is also possible, after the displacement of the dampener roller out of the throw-off position into the position wherein it rests against the connecting roller, to throw the first dampening unit roller and/or the second dampening unit roller onto the dampener roller that is already adjusted into the in-contact or resting-against position.

A further embodiment is distinguished in that the adjusting device is formed of an eccentric bearing. In addition, the adjusting device may comprise a remotely controllable actuating drive, by which the eccentric bearing can be rotated in order to displace the dampener roller onto the connecting roller and to throw the dampener roller off the connecting roller. The eccentric bearing takes up only a little construction space and, for example, being constructed in a simple way as an eccentric bushing, can be produced cost-effectively.

A further embodiment is distinguished in that, during the dampening of the planographic printing form, the dampener roller rolling on the planographic printing form and on the connecting roller can be driven by the rotary drive at a circumferential speed differing from the circumferential speed of the planographic printing form. Rolling slippage, taking effect between the planographic printing form and the dampener roller, causes a cleaning of the planographic printing form, in that fluffy paper fibers are removed from the planographic printing form by the dampener roller. With the dampening unit connected to the inking unit via the connecting roller, this cleaning of the printing form takes place during the indirect dampening of the planographic printing form via the ink applicator roller which, for this purpose, is supplied with dampening medium from the dampening unit via the connecting roller. The slippage occurs preferably as the rotary drive drives the dampener roller at a circumferential speed lower than the circumferential speed of the planographic printing form. As already mentioned herein with regard to the method according to the invention, the dampener roller may be capable of being driven by the rotary drive via a formlocking or positive gear transmission. As likewise already mentioned herein, the dampener roller may be drivable by frictional entrainment by the first dampening unit roller which, for this purpose, may, in turn, be drivable by the rotary drive via a formlocking or positive gear transmission.

The method is suitable preferably for the dampening of a planographic printing form printing by the offset printing method and may also be used for dampening a planographic printing form printing by direct planographic printing (direct lithography). The planographic printing machine may be a direct lithographic rotary printing machine and is preferably an offset rotary printing machine, by which a print carrier web or print carrier sheets can be printed.

Other features which are considered as characteristic for the invention are set forth in the appended claims.

Although the invention is illustrated and described herein as embodied in a method for dampening a planographic printing form, and dampening unit of a planographic printing machine for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
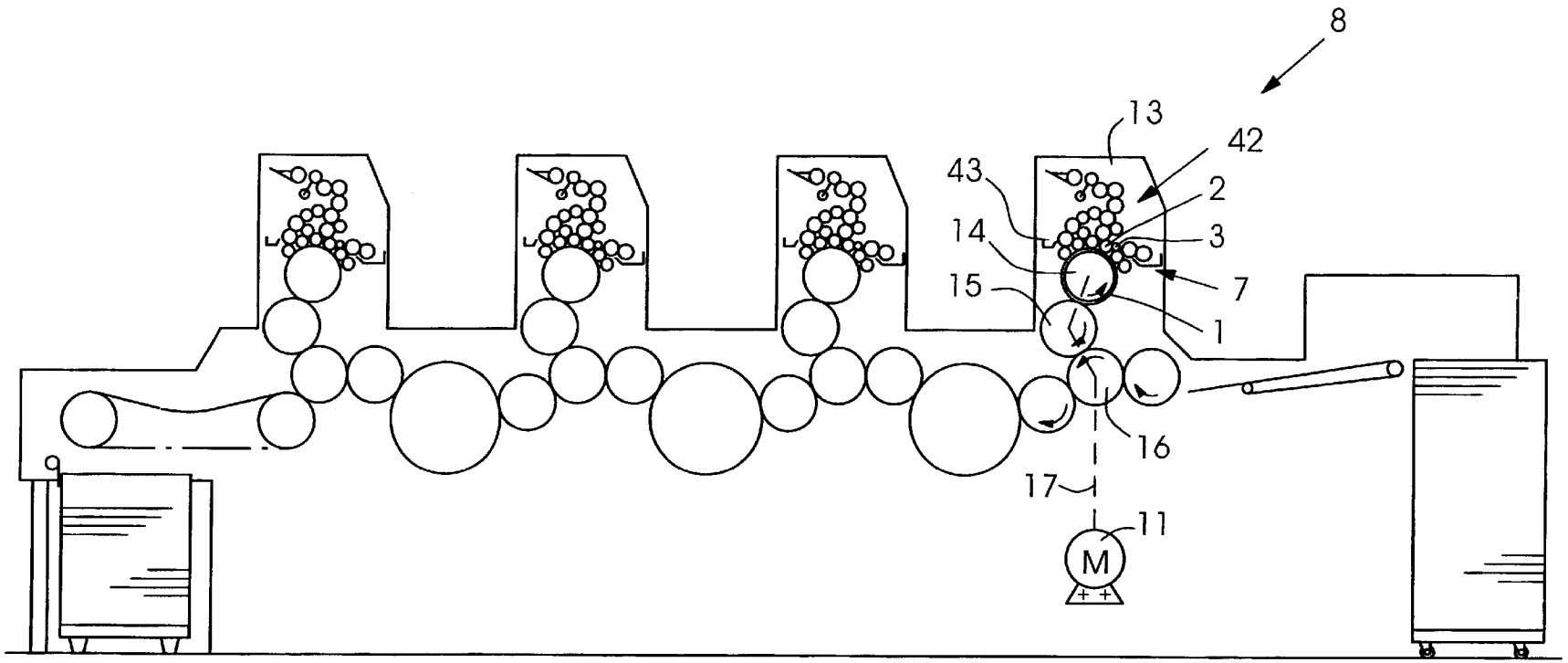
FIG. 1 is a diagrammatic side elevational view of an offset rotary printing machine having a plurality of identically constructed printing units to each of which an inking unit and a dampening unit according to the invention are assigned.

Referring now to the figures of the drawings and, first, particularly to FIG. 1 thereof, there is illustrated therein a planographic printing machine 8 constructed as a sheet-fed offset rotary printing machine having, by way of example, four printing units 13, although it may have as little as one printing unit. The printing unit 13 is formed of a printing form cylinder 14 with a planographic printing form 1 suitably clamped tautly thereon, a print-carrier guiding impression cylinder 16, and a rubber blanket cylinder 15 for transferring a printing-ink image from the planographic printing form 1 onto the print carrier. For inking the planographic printing form 1, there is assigned to the latter an inking unit 42 constructed as a ductor or vibrator-type inking unit, with an ink applicator roller 2 initially inking the planographic printing form 1 during each rotation of the printing form, and three further ink applicator rollers located downline of the ink applicator roller in the cylinder rotation direction. For dampening the planographic printing form 1, there is assigned to the latter a dampening unit 7 that can be selectively connected to or separated from the inking unit 42. With the dampening unit 7 connected to the inking unit 42, the dampening medium flows from the dampening unit 7 via the ink applicator roller 2 onto the planographic printing form 1. A rotary drive 11 therefor is an electric motor which, via a transmission 17 formed of gearwheels in meshing engagement with one another, rotatingly drives the cylinders 14, 15 and 16 for printing and during the dampening.

Figure 2:
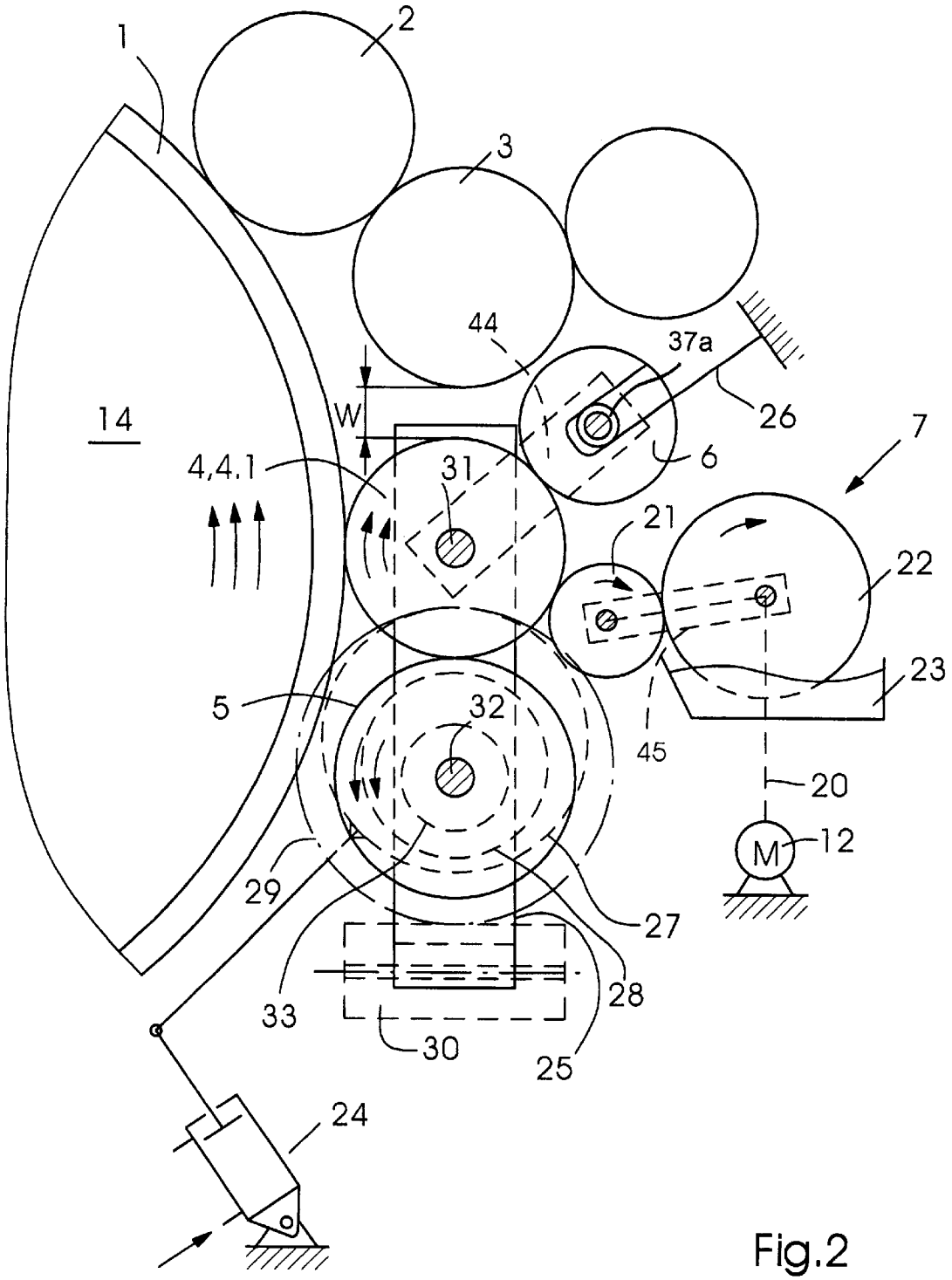
FIG. 2 is a fragmentary view of FIG. 1, showings the dampening unit directly dampening a planographic printing form.
Figure 4:
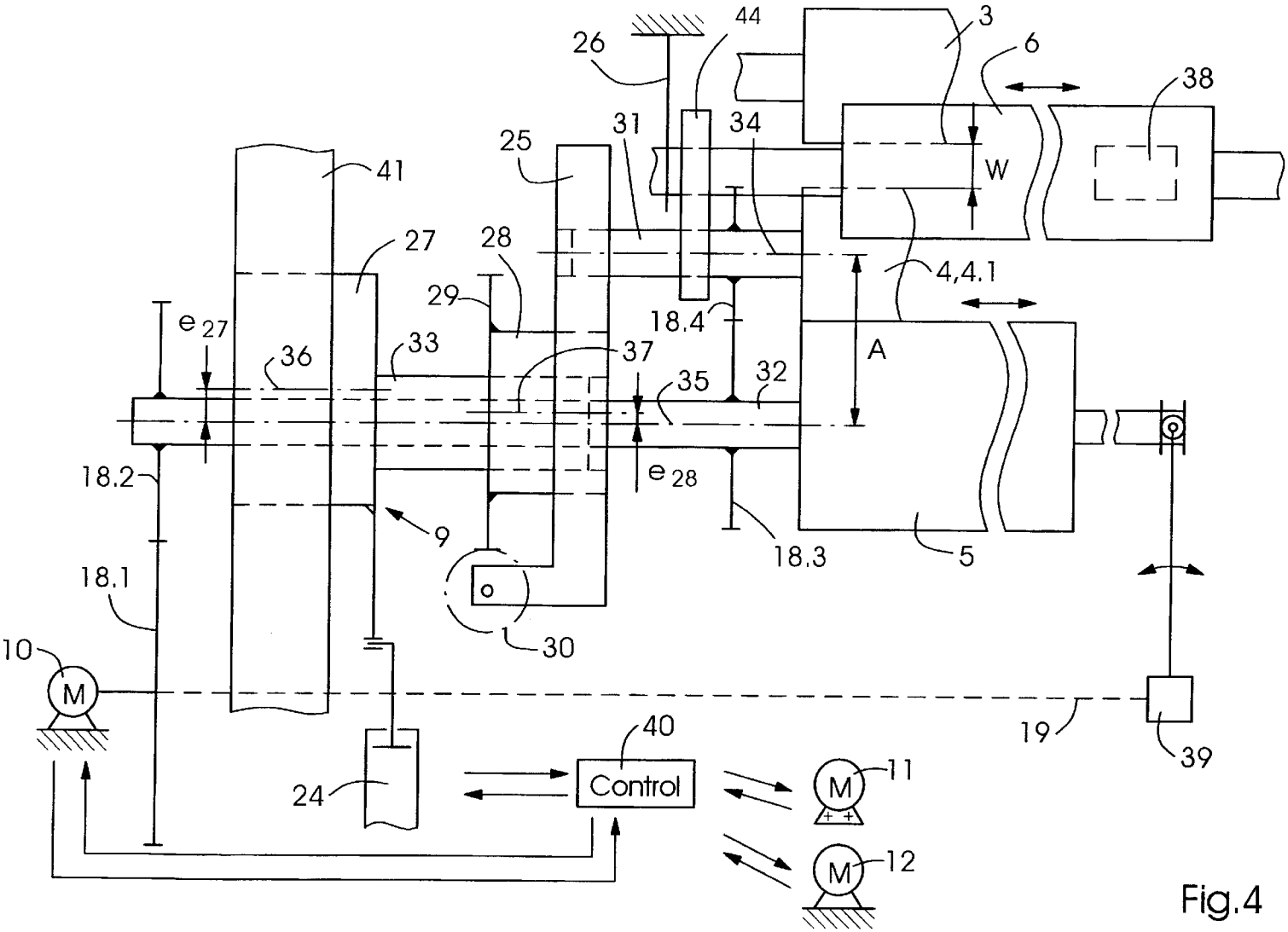
FIG. 4 is a diagrammatic elevational view of the dampening unit as seen from the righthand side of FIG. 2, showing in detail an adjusting device for jointly displacing a dampener or dampening-medium applicator roller and a dampening unit roller.

As is apparent in FIGS. 2 and 4, the dampening unit 7 is formed of a trough-shaped dampening-medium container 23, into which a dipping roller 22 dips and scoops the dampening medium, such as water, out of the dampening-medium container 23 and discharges it onto a transfer roller 21 that is in rolling contact with the dipping roller 22. The transfer roller 21 is rotatably mounted in a roller carrier 45 that is pivotable about the axis of rotation of the dipping roller 22. The rollers 21 and 22 are drivingly connected via a gearwheel transmission 20 to one another and to the rotary drive 12 constructed as an electric motor. The transfer roller 21 transfers the film of dampening water located thereon onto a dampener roller 4. The dampener roller 4 is disposed in a position thereof wherein it is in engagement with a planographic printing form 1 and applies the dampening medium, that has been taken over from the transfer roller 21, onto the planographic printing form 1. As viewed in the direction of rotation of the dampener roller 4, a first dampening unit roller 5 is in continuous engagement with the latter, following the point of engagement or contact of the dampener roller 4 with the transfer roller 21 and preceding the point of engagement or contact of the dampener roller 4 with the planographic printing form 1, and a second dampening unit roller 6 is in continuous engagement with the dampener roller 4, following the point of contact of the dampener roller 4 with the planographic printing form 1 and preceding the point of contact of the dampener roller 4 with the transfer roller 21.

A rotary drive 10 in the form of an electric motor drives the first dampening unit roller 5 via a gearwheel transmission 18.1, 18.2. The rotary drive 10 also drives the dampener roller 4. In this respect, FIG. 4 illustrates two different drive embodiments in one diagram. A formlocking or positive drive of the dampener roller 4 by the rotary drive 10 may be formed by having the rotary drive 10 drive the dampener roller 4 via a gearwheel transmission 18.3, 18.4. The gearwheel transmission 18.3, 18.4 may be formed, for example, of a gearwheel 18.3 that is connected to the first dampening unit roller 5 so as to be fixed against rotation relative thereto, and that is arranged coaxially with the latter, the gearwheel being in meshing engagement with a gearwheel 18.4 that is arranged coaxially with the dampener roller 4 and is connected thereto so as to be fixed against rotation relative thereto. The drive of the dampener roller 4 by the rotary drive 10 may also be provided by the rotary drive 10, via the gearwheel transmission 18.1, 18.2, for driving the first dampening unit roller 5, with the latter then frictionally driving the dampener roller 4 via circumferential frictional entrainment. In this case, the gearwheel transmission 18.3, 18.4 may be dispensed with.

In FIG. 2, three arrows assigned to the planographic printing form 1 and lying closely adjacent one another symbolize that the planographic printing form 1 rotates at a comparatively high circumferential speed. Respective pairs of arrows assigned to each of the rollers 4 and 5 indicate that the rollers 4 and 5 rotate relative to one another at the same circumferential speed which is only slightly slower than the circumferential speed of the planographic printing form 1. An arrow assigned, respectively, to the rollers 21 and 22 indicate that the rollers 21 and 22 also rotate relative to one another at the same circumferential speed which, however, is considerably lower than the circumferential speed of the dampener roller 4. The speed difference existing between the rollers 4 and 21 can be regulated by an electronic control device 40 that activates the rotary drive 12, for the accurate metering of the quantity of dampening medium transferred from the roller 21 to the roller 4 at the mutual contact location thereof.

The control device 40 controls the rotary drives 10 and 12 in co-ordination with one another and in dependence upon the rotary drive 11, so that, in the event of an increase or decrease in the circumferential speed of the planographic printing form 1, corresponding to a change in printing speed, the rotary drives 10 and 12 are capable of following up the drive 11 in the corresponding speed adjustment direction.

In a further embodiment not illustrated in any greater detail, the rotary drives 10 and 11 are not two different electric motors, but one and the same electric motor.

Figure 3:
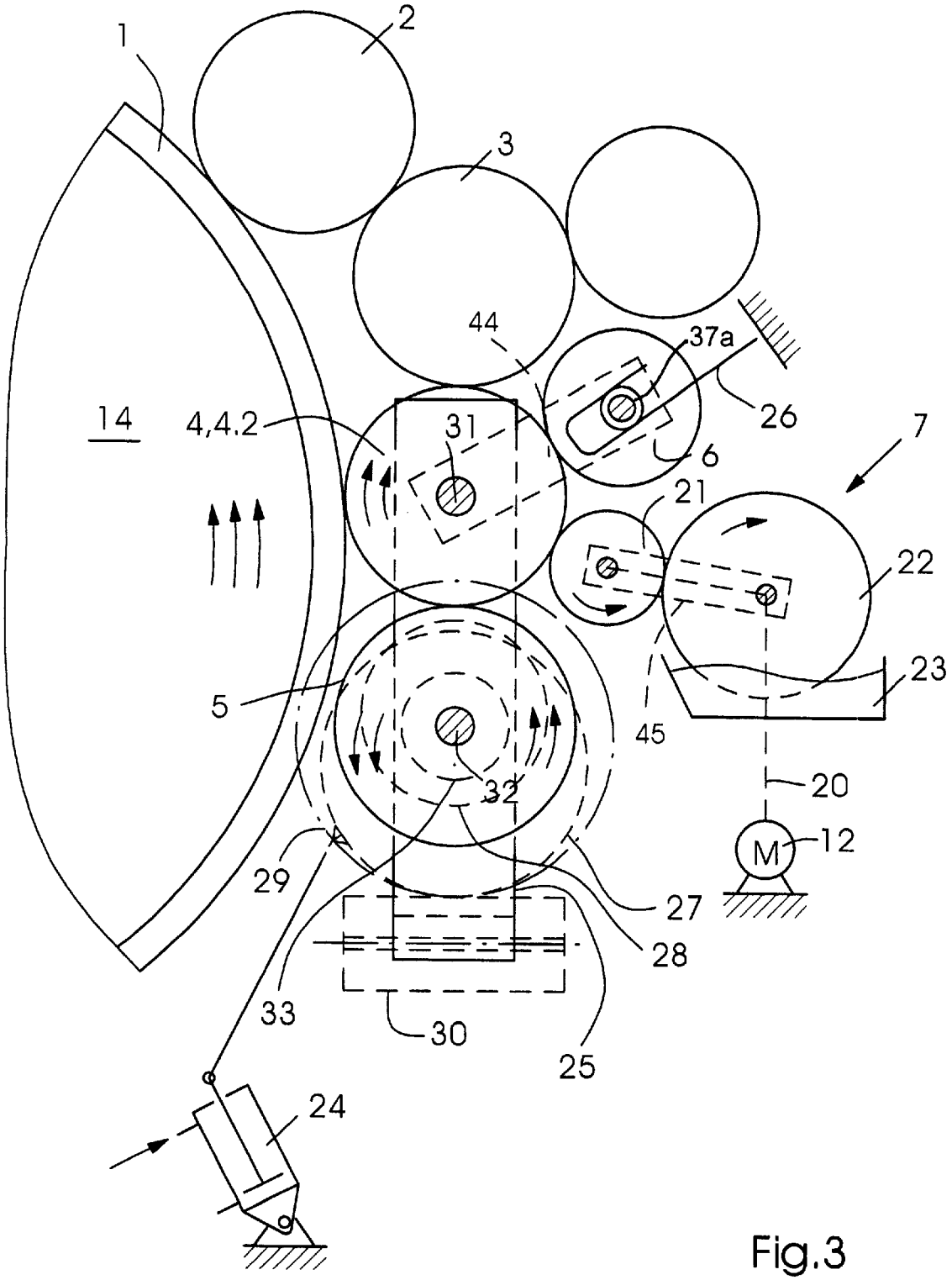
FIG. 3 is a view like that of FIG. 2, in another operating phase of the dampening unit wherein the dampening unit indirectly dampens the planographic printing form with a printing ink/dampening medium emulsion both via a dampener roller and via an ink applicator roller.

Moreover, in the embodiment illustrated in FIG. 4, the control device 40 controls an actuating drive 24 which belongs to an adjusting device 9 and which is a lifting-piston cylinder capable of being activated by pressure fluid, for example, a pneumatic cylinder. The adjusting device 9 makes it possible to adjust the dampener roller 4 from the position 4.1 thereof shown in FIG. 2, wherein it is thrown off from a connecting roller 3 connecting with the inking unit 42, into a position 4.2 thereof shown in FIG. 3, wherein it is thrown onto the connecting roller 3, and also out of the position 4.2 back into the position 4.1 again. The connecting roller 3 does not have to be displaced for coupling the dampening unit 7 to the inking unit 42 and may be mounted in a locally fixed rotary bearing and a frame-fixed rotary bearing, respectively.

In order to perform these displacements, an eccentric bearing belonging to the adjusting device 9 and formed as a first eccentric bushing 27 is rotatable about a central axis 36 thereof by the actuating drive 24. The eccentric bearing or bushing 27 carries a roller carrier 25 that is formed as an adjustable bearing plate wherein a roller journal 31 of the dampener roller 4 is rotatably mounted and through which a shaft journal 32 of the first dampening unit roller 5 extends. The first eccentric bearing 27 carries a second eccentric bearing 28 which is likewise formed as an eccentric bushing and is rotatable manually about a central axis 37 thereof.

A worm gear 29 is fastened to the eccentric bearing 28 so as to be coaxial therewith, and meshes with a worm 30 mounted rotatably in the roller carrier 25. With the aid of a tool insertable into or slidable onto the worm 30, the latter and, therewith, the eccentric bearing 28, is rotatable. The eccentric bearing 27 may be mounted so as to be rotatable about the central axis 36 thereof in a side wall 41 by a rolling-body or slide bearing. The rollers 4 and 5 and the eccentric bearing 28 may also be mounted rotatably by such rotary bearings. The eccentricity $e_{27}$ describes the amount by which the central axis 35 of the first dampening unit roller 5 is offset relative to the central axis 36 of the eccentric bearing 27. The eccentricity $e_{27}$ of the eccentric bearing 27 with respect to the central axis 36 of the latter is such that a rotation of the eccentric bearing 27 through a defined angle of rotation causes a joint displacement of the rollers 4 and 5 over a roller distance W, depending upon the direction of rotation of the eccentric bearing 27 towards or away from the connecting roller 3. For example, the eccentricity $e_{27}$ may be approximately 15 mm. The roller journal 32 is rotatably received in a bore penetrating the eccentric bearing 27 and the bushing-shaped shoulder 33 thereof which is thus likewise offset by the eccentricity $e_{27}$ relative to the central axis 36. The eccentric bearing 28 is formed with a bore that is offset relative to the central axis 37 by the eccentricity $e_{28}$, the bushing shoulder 33 being insertable rotatably into this bore.

In other embodiments not illustrated in any greater detail, a bushing shoulder 33 attached to or integrally formed on the eccentric bearing 28 may be inserted rotatably into the eccentric bearing 27. Also, a bushing connecting the eccentric bearings 27 and 28 to one another in a rotationally articulated manner may be inserted, instead of the bushing shoulder 33, both into the eccentric bearing 27 and the eccentric bearing 28.

In the embodiment illustrated in FIG. 4, the extent of the eccentricity $e_{28}$ is considerably smaller than the extent of the beccentricity $e_{27}$ and may, for example, be approximately 2 mm. A rotation of the eccentric bearing 28 by the worm gear 29, 30 about the central axis 37 causes an increase or decrease in the spaced distance A between the central axes 34 and 35, respectively, of the rollers 4 and 5 relative to one another, depending upon the direction of rotation, so that the strength with which the rollers 4 and 5 are pressed against one another is adjustable. The variation in the center distance A is produced, depending upon the direction of rotation of the eccentric bearing 28, by a displacement of the dampener roller 4 towards or away from the first dampening unit roller 5 and by a displacement of the roller carrier 25 relative to the central axis 35, respectively. The spaced distance A is set within an adjusting range, wherein the contact pressure existing between the rollers 4 and 5 is sufficiently high for the rotary frictional entrainmant of the roller 4 by the roller 5 or wherein the gearwheels 18.3 and 18.4 remain in effective mutual meshing engagement.

This applies in a similar manner to the gearwheel 18.2 arranged coaxially with the first dampening unit roller 5 and connected thereto so as to be fixed against rotation relative thereto. During any joint displacement of the first dampening unit roller 5 and the dampener roller 4 wherein the roller spacing or distance W between the rollers 3 and 4 is produced or cancelled, the gearwheel 18.2 remains in constant effective engagement with the gearwheel 18.1 driving the gearwheel 18.2.

The actuating drive 24 is preferably a double-acting lifting-piston cylinder that is extensible by applying pressure fluid to the front face of a piston and is retractable by applying pressure fluid to the rear face of the piston, the cylinder having a piston rod that is articulated eccentrically on the eccentric bearing 27. The rotary drive 10 rotatably driving the first dampening unit roller 5 and which, as described hereinbefore, may be an electric motor separated from the rotary drive 11 of the planographic printing form 1 or the rotary drive 11 itself, is drive-coupled via a further gearwheel transmission 19 with a traversing drive 39 for the axial oscillation of the first dampening unit roller 5. For example, the traversing drive 39 illustrated diagrammatically in FIG. 4 may be a crank mechanism which is driven by the rotary drive 10 and imparts an axial distributing stroke movement to the rotating first dampening unit roller 5 via an oscillating driver or entrainer roller engaging on a roller journal of the first dampening unit roller 5.

In the circumferential region located between the point of contact of the dampener roller 4 with the connecting roller 3 and the point of contact of the dampener roller 4 with the transfer roller 21, a second dampening unit roller 6 is disposed in continuous contact with the dampener roller 4. The second dampening unit roller 6 is a so-called rider roller which is simultaneously formed as an axially oscillating distributor roller. The second dampening unit roller 6 is mounted rotatably in a roller carrier 26 fixed to the machine frame. The second dampening unit roller 6 is readjustable to the displacements of the dampener roller 4 in the positions 4.1 and 4.2 of the latter, in that the roller shaft of the second dampening unit roller 6 is guided in the roller carrier 26 in a guide allowing compensating movements of the second dampening unit roller 6. A linear guide that is preferred for this purpose may be formed, for example, of a round grooved block 37*a* which, as shown, formed as a bushing, at least partly surrounds a roller journal of the second dampening unit roller 6 or which may be fastened as a roller coaxially with the roller journal. The grooved block 37*a* is guided in a groove or slot formed in the roller carrier 26 and is fastened to a couple or link 44. Such a guide, indicated diagrammatically in FIGS. 2 and 3 and not shown in any greater detail therein, is arranged on both sides of the second dampening unit roller 6.

The dampener roller 4 and the second dampening unit roller 6 are mounted rotatably in the couple or link 44. By an otherwise no further illustrated adjustment device, for example, a screw, the spacing between the axes of the rollers 4 and 6 and, therefore, the pressing strip width, can be set by the adjustment of the second dampening unit roller 6.

Alternatively to the illustrated embodiment, the second dampening unit roller 6 may be held by the roller carrier 26 so as to follow pivotably the displacement of the dampener roller 4.

FIG. 4 shows that the second dampening unit roller 26 has a so-called internal traversing drive 38 that is integrated in the body of the roller 26, and that constitutes a transmission which additionally converts the rotational movement of the second dampening unit roller 6 formlockingly or positively into an axial oscillation. The traversing drive 38 may, for example, be a cam mechanism. The axial oscillation of the second dampening unit roller 6 is produced by the rotary drive 10 via the dampener roller 4 which frictionally drives the second dampening unit roller 6 rotatably.

Furthermore, FIG. 4 illustrates the mounting of the rollers 4 and 5 on the so-called drive side of the printing machine. On the non-illustrated so-called operating side of the printing machine 8, that is located opposite the drive side, the rollers 4 and 5 are mounted in a further roller carrier corresponding essentially to the roller carrier 25 and in further eccentric bearings corresponding essentially to the eccentric bearings 27 and 28. The drive-side adjusting device 9 that is shown may be coupled via a synchronizing transmission with the non-illustrated operating-side adjusting device, so that the two adjusting devices are rotatable simultaneously by the actuating drive 24. In the simplest case, the eccentric bearing 27 may be connected to the operating-side eccentric bearing, constructed mirror-symmetrically to the latter with respect to a vertical axis, by a connecting rod eccentric with respect to the central axis 36 of the eccentric bearing and fastened to both eccentric bearings, so that tilting of the rollers 4 and 5 during the displacement thereof is prevented.

It is not only advantageous, in the device illustrated in FIGS. 1 to 4, that, during the dampening of the planographic printing form 1, the dampener roller 4 rotates at a circumferential speed differing from the circumferential speed of the planographic printing form 1 and thus removes from the planographic printing form 1 impurities which are located on the latter. It is also advantageous that, during dampening, the first dampening unit roller 5 be driven formlockingly or positively by the rotary drive 10, and the first dampening unit roller 5 be in engagement with the dampener roller 4 when the latter is in engagement with the connecting roller 3. This affords the possibility, of evenly distributing or equalizing the dampening medium located on the dampener roller 4, even in the operating mode wherein the dampening unit 7 is coupled to the inking unit 42. Moreover, a rotary drive of the dampener roller 4, both in the position 4.1 and the position 4.2 thereof, via frictional entrainment by the first dampening unit roller 5 is possible.

In the illustrated dampening unit 7, it is no longer absolutely necessary for the dampener roller 4 to oscillate in the axial direction during the dampening of the planographic printing form 1. It has been shown that, in many cases, more uniform dampening can be achieved with a dampener roller 4 that is not moved axially, rather than with an axially oscillating dampener roller. Due to the fact that the rollers 4 and 5 are held in continuous circumferential contact with one another by the roller carrier 25, and the adjusting device 9 ensures displacement while, simultaneously, permanently maintaining the spacing or distance A set by the adjustment device formed essentially of the eccentric bearing 28, the so-called pressing strip of the rollers 4 and 5 is absolutely stable. The pressing strip is a circumferential flattening or flat region of the dampener roller 4, extending along the line of contact between the rollers 4 and 5, the dampener roller 4 which, for example, is rubberized on the outside thereof, being comparatively soft.

The first dampening unit roller 5 is comparatively hard and, for example, metallic, and has preferably a circumferential surface which is rough or structured with coarse elevations and/or depressions and which is chromium-plated. In contrast with heretofore known dampening units (the published German Patent Document DE 91 10 345), printing ink located on the first dampening unit roller 5 cannot dry on the latter, for example, when the dampening unit 7 is converted or changed over from the "direct dampening" operating mode shown in FIG. 2 into the "indirect dampening" operating mode shown in FIG. 3 and is coupled to the inking unit 42, respectively. In the illustrated dampening unit 7, this changeover or conversion is possible not only when the printing machine 8 is at a standstill, but also when it is running. The adjusting device 9, the displaceable roller carrier 25 and the roller carrier 26 ensure that the dampening unit rollers 5 and 6 are thus in permanent or continuous contact with the dampener roller 4 both when the dampener roller 4 is thrown onto the planographic printing form 1 and when the dampener roller 4 is thrown off the planographic printing form 1.

A further advantage, as compared with the aforementioned dampening unit heretofore known from the prior art, is that, in the illustrated dampening unit 7, the first dampening unit roller 5 engaging solely with the dampener roller 4 can also be washed by a cleaning device 43 assigned to the inking unit 42. The cleaning device 43 includes a cleaning fluid supply, formed, for example, as a spray tube, on a roller of the inking unit 42, and a doctor blade throwable onto a roller of the inking unit 42 and having a doctor trough collecting the printing ink wiped off the roller. In order to clean the dampening unit 7, the circumferential contact between the rollers 4 and 21 can be cancelled and the dampener roller 4 is thrown, in the position 4.2 thereof, onto the connecting roller 3, so that the cleaning fluid introduced into the inking unit 42 by the cleaning device 43 passes via the rotating connecting roller 3 onto the rotating dampener roller 4 and, thus, from the latter onto the dampening unit rollers 5 and 6 which are consequently also cleaned by the cleaning device 43 and do not need to be cleaned manually by the pressman.

We claim:

1. A dampening unit of a planographic printing machine, comprising:

a dampener roller;

a connecting roller;

a first dampening unit roller in contact solely with said dampener roller;

an adjusting device for displacing said dampener roller out of a spaced-away position and into an in-contact position;

said dampener roller being out of contact with said connecting roller in the spaced-away position, and said dampener roller being in contact with said connecting roller in the in-contact position;

a rotary drive for formlockingly driving said first dampening unit roller;

said first dampening unit roller being in contact with said dampener roller upon said dampener roller being in the in-contact position; and said dampener roller and said first dampening unit roller being displaceable jointly by said adjusting device, so that said dampener roller is displaceable out of said spaced-away position and in said in-contact position and, simultaneously, said first dampening unit roller is entrainable thereby by being in permanent contact with said dampener roller.

2. The dampening unit according to claim 1, including a second dampening unit roller in contact solely with the dampener roller.

3. The dampening unit according to claim 2, wherein the dampener roller, said first dampening unit roller and said second dampening unit roller are jointly displaceable by said adjusting device, so that the dampener roller is displaceable out of said spaced-away and into said in-contact position and, simultaneously, both said first dampening unit roller and said second dampening unit roller are entrainable therewith by being in permanent contact with the dampener roller.

4. The dampening unit according to claim 1, wherein said adjusting device comprises an eccentric bearing.

5. The dampening unit according to claim 1, wherein the dampener roller which, in the in-contact position, is in contact with said connecting roller, is drivable by said rotary drive with slippage relative to a planographic printing form, so as to roll on the latter.

6. A planographic printing machine having at least one dampening unit constructed in accordance with the features of claim 1.

7. The planographic printing machine according to claim 6, wherein the printing machine is an offset rotary printing machine.

* * * * *